United States Patent [19]

Hurley

[11] 4,322,001

[45] Mar. 30, 1982

[54] PROTECTIVE CASE FOR A SPORTS CARD OR SIMILAR COLLECTIBLE ARTICLE

[76] Inventor: Patrick S. Hurley, 5675 Belmont Ave., Cincinnati, Ohio 45224

[21] Appl. No.: 202,364

[22] Filed: Oct. 29, 1980

[51] Int. Cl.[3] ..... B65D 43/16; B65D 85/48

[52] U.S. Cl. ..... 206/449; 206/455; 206/459; 206/45.34; 220/306; 220/339

[58] Field of Search ..... 206/449, 0.84, 459, 206/455, 45.34; 220/306, 307, 339; 150/0.5

[56] References Cited

U.S. PATENT DOCUMENTS

| | | | |
|---|---|---|---|
| 3,443,720 | 5/1969 | Al-Roy | 220/307 |
| 3,489,313 | 1/1970 | Haugen | 220/339 |
| 3,624,939 | 12/1971 | Gossard | 206/0.84 |
| 3,797,649 | 3/1974 | Ringle | 220/339 |
| 3,861,433 | 1/1975 | Schier et al. | 150/0.5 |
| 4,060,173 | 11/1977 | Dahl | 220/306 |

*Primary Examiner*—William T. Dixson, Jr.
*Attorney, Agent, or Firm*—Wood, Herron & Evans

[57] ABSTRACT

A case is disclosed for protecting a collectible article, such as a baseball card, photograph, or the like. The article is enclosed within the protective case which comprises a base and a cover. Both the base and cover are preferably constructed from transparent elastic material, such as clear polyvinyl plastic. The base includes a peripheral boss which encircles the article when the article is placed on the base, and the cover includes a downturned edge which interlocks with the boss when the cover is applied to the base. Preferably, the boss of the base is angled outwardly, and the downturned edge of the cover is angled inwardly, so that the base and cover snap fit together due to the elasticity of the material used for constructing the base and cover, thereby sealing the article within the protective case. Preferably, a flange surrounds the boss of the base, and another flange surrounds the downturned edge of the cover, for increasing the rigidity of the protective case. The flanges of the base and cover along one side of the protective case preferably extend outwardly and form tabs which facilitate opening the protective case after the base and cover are joined together. Other features are also disclosed.

17 Claims, 2 Drawing Figures

PROTECTIVE CASE FOR A SPORTS CARD OR SIMILAR COLLECTIBLE ARTICLE

BACKGROUND OF THE INVENTION

This invention relates to receptacles and, more particularly, to closed receptacles for storing articles. Specifically, the invention is directed to a case for protecting a collectible article, such as a sports card, photograph, or the like, thereby preserving the condition of the article.

Many people devote their leisure time to the pursuit of hobbies. People enjoy a great variety of hobbies too numerous to list. Although the invention has utility in other areas, as will become apparent, the invention was originally developed for the hobby area, specifically, for preserving the condition of articles collected by hobbyists.

Hobbyists collect many different things, such as postage stamps, coins, and so on. Besides the more popular collectible articles, hobbyists also collect other articles of interest, such as sports cards, for example, baseball cards, football cards, etc. Some sports cards are quite rare and have become quite valuable as a result of the recent growth in popularity of the hobby.

The condition of a rare sports card contributes significantly to the value. Nevertheless, active hobbyists are likely to handle their collections frequently, which subjects their sports cards to the risk of being soiled, worn, torn, or otherwise damaged. Consequently, there is a need for protecting the sports cards when they are handled. Additionally, there is a need for indexing sports card collections so that hobbyists can browse through their collections easily. Furthermore, there is a need for labeling sports cards so that hobbyists can more readily identify and maintain a record of the sports cards in their collections.

Also, professional dealers who sell sports cards are exposed to an even greater risk of damage to sports cards in their inventories due to the number of collectors who are likely to handle the sports cards which they sell. In addition, there is a need for indexing sports card inventories so that dealers can check their merchandise readily. Furthermore, there is a need for labeling sports cards so that dealers can more easily identify and maintain a record of the sports cards which they sell.

There are few commercially available products which can be utilized for protecting sports cards. One product comprises a sheet of clear plastic which is folded along one edge and heat sealed along one or perhaps two other edges, thereby forming a sleeve which is open along at least one edge so that a sports card can be inserted. However, since one or more edges of the sleeve are not sealed, the inserted sports card is exposed to dirt and other agents which might soil or otherwise damage the sports card within the sleeve. Such a sleeve does not provide a convenient technique for indexing sports cards. Nor does such a sleeve facilitate labeling a sports card without masking a portion of the sports card with writing or labels.

Also on the market are hinged plastic boxes. Such boxes have unsealed joints, do not facilitate indexing or labeling sports cards, and, in addition, are quite bulky and unwieldy.

Nor do the commercially available products utilized for protecting currency, postage stamps, photographs, and the like satisfy the needs in the sports card area. The products for protecting such other articles have basically the same shortcomings as already discussed.

SUMMARY OF THE INVENTION

One objective of the invention is to provide a case for protecting a collectible article, such as a sports card, photograph, or the like.

Another objective is to provide a protective case which is effectively sealed along all edges for preventing an enclosed article from being soiled.

Another objective is to provide a protective case which can be easily opened and closed for inserting and removing an article.

A further objective is to provide a protective case having the above features which allows indexing articles.

An additional objective is to provide a protective case having the above features which facilitates labeling an article without obscuring a portion of the article.

A further objective is to provide a protective case having the above features which is simply and economically constructed from a material which allows an article enclosed within the protective case to be viewed.

In accordance with a preferred embodiment of the invention, a case is provided for protecting a collectible article, such as a sports card, photograph, or the like. The protective case comprises two elements, a base and a cover, which are joined together for enclosing the article.

Both the base and cover are preferably constructed from transparent elastic material, such as clear polyvinyl plastic. The base includes a peripheral boss which encircles the article when the article is placed on the base. The cover includes a downturned edge. The boss of the base and the downturned edge of the cover are mutually configured so that the downturned edge interlocks with the boss when the cover is applied to the base. Preferably, the boss of the base is angled outwardly at an obtuse angle, and the downturned edge of the cover is angled inwardly at a supplementary acute angle, so that the base and cover snap fit together due to the elasticity of the material used for constructing the base and cover, thereby sealing the article within the protective case.

Preferably, a flange surrounds the boss of the base, and another flange surrounds the downturned edge of the cover, for increasingd the rigidity of the protective case. The flanges of the base and cover along one side of the protective case preferably extend outwardly and form tabs which facilitates opening the protective case after the base and cover are joined together.

The protective case of the invention protects the enclosed article. The protective case is effectively sealed along all edges as a result of the snap-fit between the boss of the base and the downturned edge of the cover for preventing the enclosed article from being soiled. The tabs permit the protective case to be easily opened for removing an article and are configured so that they allow indexing articles as well as labeling each article without obscuring a portion of the article. The protective case can be simply and economically constructed with a standard vacuum-form machine and die cutter using clear polyvinyl plastic sheet material which allows the article enclosed within the protective case to be viewed.

BRIEF DESCRIPTION OF THE DRAWINGS

The above and other objectives and features of the protective case of the invention will be more readily appreciated by those skilled in the art after a consideration of the description of a preferred embodiment which is given below in connection with the accompanying drawings. In the drawings.

DESCRIPTION OF A PREFERRED EMBODIMENT

Figure 1:
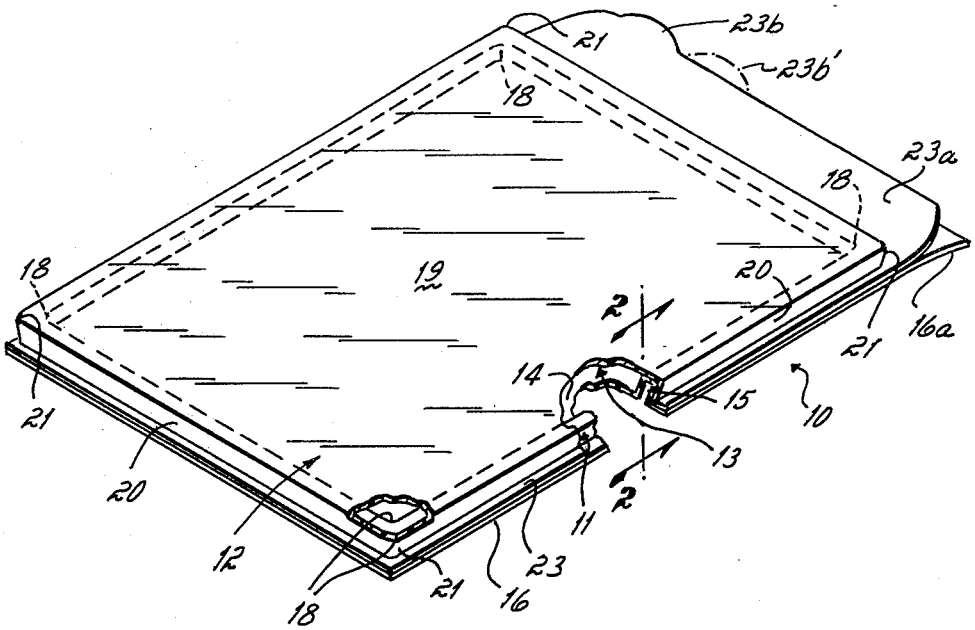
FIG. 1 is an isometric view of a preferred embodiment of the protective case of the invention.

A preferred form for the protective case of the invention is generally indicated in the drawings by the numeral 10. As shown in FIG. 1, protective case 10 includes two elements, a base 11 and a cover 12, which are joined together for enclosing an article (not shown). The article is contained in a region 13 formed between base 11 and cover 12.

Both base 11 and cover 12 of protective case 10 are preferably constructed using transparent elastic material. Base 11 and cover 12, for example, may be constructed using 10–20 mils clear polyvinyl plastic sheet material. Transparent material is preferred for constructing base 11 and cover 12 so that the article enclosed within protectives case 10 can be viewed.

Figure 2:
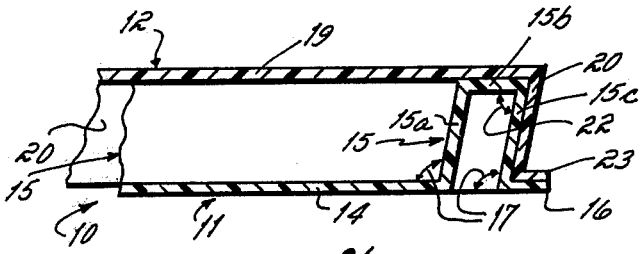
FIG. 2 is a partial cross-sectional view of the preferred protective case taken along the line 2—2 in FIG. 1.

As shown in FIGS. 1 and 2, base 11 of protective case 10 includes a planar section 14 bounded by a peripheral boss 15 formed integrally with the planar section. Boss 15 encircles the article to be enclosed within protective case 10 when the article is placed on base 11. Planar section 14 is sized slightly in excess of the dimensions of the article to be enclosed within protective case 10. The corners of boss 15 are preferably radiused as shown in FIG. 1.

As shown most clearly in FIG. 2, boss 15 of base 11 includes an inner wall **15*a*, which adjoins planar section 14, a ridge 15*b*, which is contiguous with inner wall 15*a*, and an outer wall 15*c*, which is contiguous with ridge 15*b*. Preferably, inner wall 15*a* and outer wall 15*c* are angled outwardly at an obtuse angle 17 with respect to planar section 14**.

A flange 16 preferably surrounds boss 15 of base 11 as shown in FIGS. 1 and 2 for increasing the rigidity of the base. Flange 16 preferably extends outwardly along one side of base 11 and forms a tab **16*a*** on the base for purposes which will be described later.

As shown in FIG. 1, cover 12 includes a flat section 19 bounded by an integral downturned edge 20. The corners 21 of cover 12 are preferably radiused as shown in FIG. 1. Corners 21 of cover 12 are similarly radiused to corners 18 of base 11.

As shown most clearly in FIG. 2, downturned edge 20 of cover 12 is angled inwardly at an acute angle 22 with respect to flat section 19. Acute angle 22 forms the supplement of obtuse angle 17.

Another flange 23 preferably surrounds downturned edge 20 of cover 12 as shown in FIGS. 1 and 2 for increasing the rigidity of the cover. Flange 23 preferably extends outwardly along one side of cover 12 and forms a tab **23*a* on the cover similar to tab 16*a* on base 11**.

In order to protect an article within protective case 10, the article is placed on planar section 14 of base 11 so that the article is encircled by boss 15. Cover 12 is then applied to base 11 so that downturned edge 20 of the cover interlocks with boss 15 of the base.

When base 11 and cover 12 of protective case 10 are joined, a snap-fit is effected between the base and cover as a result of two factors. The first factor is the elasticity of the material preferably used for constructing both base 11 and cover 12. The second factor is the angular relationship of outer wall **15*c* of boss 15 of base 11 with downturned edge 20 of cover 12. Since outer wall 15*c* is angled outwardly at obtuse angle 17 and downturned edge 20 is angled inwardly at acute angle 22, which forms the supplement of the obtuse angle, and since the material used for constructing base 11 and cover 12 is elastic, the base and cover snap fit together, thereby sealing the article within protective case 10 when the base and cover are joined together. The snap-fit between boss 15 of base 11 and downturned edge 20 of cover 12 provides a substantially impervious seal between the outside of protective case 10 and region 13** within the protective case for preventing the article enclosed within the protective case from being soiled.

Tabs **16*a* and 23*a* are preferably provided for one primary purpose and several subsidiary purposes. Tab 16*a* can be grasped by the fingers of one hand, and tab 23*a* can be grasped by the fingers of the other hand, and the tabs can be pulled apart so that protective case 10 can be easily opened for removing the article enclosed within the protective case. Furthermore, tabs 16*a* and 23*a* of a plurality of protective cases 10 can be configured slightly different, such as by providing tabs which extend outwardly different distances or are provided with a different projection, such as 23*b* or 23*b*′ along the edge of tab 23*a*, for indexing articles enclosed within the protective cases. Tabs 16*a* and 23*a* also facilitate labeling each article, such as by marking or applying pressure-sensitive adhesive labels to the tabs, without obscuring a portion of the article enclosed within protective case 10**.

In an exemplary construction of protective case 10, planar section 14 of base 11 had dimensions slightly in excess of $2\frac{1}{2}$ inches$\times 3\frac{1}{2}$ inches, which is the size of the most common type of baseball card, but might have had dimensions slightly in excess of $2\frac{5}{8}$ inches$\times 3\frac{3}{4}$ inches, which would accommodate other sizes of baseball cards, such as those which measure $2\frac{5}{8}$ inches$\times 3\frac{3}{4}$ inches or $2\frac{1}{2}$ inches$\times 3\frac{3}{4}$ inches. The width of ridge **15*b* of boss 15 of base 11, that is, the distance between inner wall 15*a* and outer wall 15*c* of boss 15, measured 1/16 inch. The height of boss 15, that is, the distance between planar section 14 and ridge 15*b* of the boss, measured 3/16 inch. Obtuse angle 17 measured 100°. Flange 16 extended outwardly from boss 15 a distance of 1/16 inch, while tab 16*a* extended outwardly a distance of $\frac{1}{2}$ inch. The height of downturned edge 20 of cover 12, that is, the distance between flat section 19 and flange 23, measured 3/16 inch. Acute supplementary angle 22 measured 80°. Flange 23 extended outwardly from downturned edge 20 a distance of 1/16 inch, while tab 23*a* extended outwardly a distance of $\frac{1}{2}$ inch. Corners 18 of base 11 and corners 21 of cover 12** were radiused 3/32 inch.

Protective case 10 of the invention can be constructed simply and economically. Base 11 and cover 12 can be constructed using plastic sheet material with a standard vacuum-form machine, such as an Atlas or a Sentinel vacuum-form machine, and a die cutter.

A preferred embodiment of the protectives case of the invention has been described, and an exemplary construction has been given, by way of example and not by way of limitation. Various uses and modifications will appear to those skilled in the art. One such modification would be to construct only one of the elements, the base or the cover, from elastic material and the other element from what might be considered a non-elastic material, such as metal, for example, aluminum sheet. Also, only the outer wall of the boss might be angled outwardly; that is, the inner wall of the boss could be vertical, for example, and the snap-fit between the boss of the base and the downturned edge of the cover would still be maintained. Furthermore, other forms of interlock arrangement, such as a boss having an outwardly bowed or ribbed outer wall and a downturned edge having a reciprocably outwardly bowed or channeled downturned edge, are also contemplated, although more complex than the interlock arrangement of the preferred embodiment. Other modifications are also contemplated and are considered to fall within the spirit of the invention. Consequently, reference must be made to the appended claims in order to ascertain the true scope of the invention.

I claim:

1. A case for protecting a relatively thin article such as a paper collectible which may be a sports card or a photograph or a like article comprising:

a base constructed from elastic material, the base including a peripheral boss which encircles the article when the article is placed on the base, the boss being angled outwardly at an obtuse angle, the height of the boss being less than one-quarter inch whereby typically the boss is of a height which exceeds the thickness of said relatively thin article and yet permits the placing of a relatively small number of such articles on the base within said peripheral boss, the number being dependent upon the article thickness; and a cover constructed from elastic material, the cover including a downturned edge, the downturned edge extending downwardly less than one-quarter inch and being angled inwardly at an acute angle so that the inwardly angled downturned edge interlocks with the outwardly angled boss when the cover is applied to the base, at least a substantial portion of at least one of said base and cover being of a substantially transparent material to permit viewing an article in the case;

whereby the base and cover snap fit together for sealing the article within a region formed between the base and cover.

2. The protective case of claim 1 further comprising a flange around the boss and another flange around the downturned edge for increasing the rigidity of the protective case.

3. The protective case of claim 1 further comprising one tab along a side of the base and another tab along a corresponding side of the cover which facilitate opening the protective case after the base and cover are joined together.

4. The protective case of claim 3 wherein one of the tabs includes a projection which facilitates indexing the article enclosed within the protective case.

5. The protective case of claim 3 wherein the tabs extend adjacent one another more than three-eights of an inch beyond the boss and the downturned edge and are sized for marking and applying pressure-sensitive adhesive labels for labeling the article enclosed within the protective case.

6. The protective case of claim 1 wherein a substantially impervious seal is formed between the base and cover for preventing the article enclosed within the protective case from being soiled.

7. The protective case of claim 1 wherein the material used for constructing the base and cover is transparent plastic material.

8. A case for protecting a relatively thin article such as a paper collectible which may be a sports card or a photograph or a like article comprising:

one element including a peripheral boss which encircles the article when the article is placed on the one element; and a second element including a downturned edge;

at least one of the elements being constructed from elastic material;

the boss of the one element and the downturned edge of the second element being mutually configured so that the downturned edge interlocks with the boss when the second element is applied to the one element and, the height of the boss and the downturned edge being less than one-quarter inch whereby typically the boss is of a height which exceeds the thickness of said relatively thin article and yet permits the placing of a relatively small number of such articles on the base within said peripheral boss, the number being dependent upon the article thickness;

whereby the two elements snap fit together for sealing the article within a region formed between the two elements, at least a substantial portion of at least one of said base and cover being of a substantially transparent material to permit viewing an article in the case.

9. The protective case of claim 8 further comprising a flange around the boss and another flange around the downturned edge for increasing the rigidity of the protective case.

10. The protective case of claim 8 further comprising one tab along a side of the one element and another tab along a corresponding side of the second element which facilitate opening the protective case after the two elements are joined together.

11. The protective case of claim 10 wherein one of the tabs includes a projection which facilitates indexing the article enclosed within the protective case.

12. The protective case of claim 10 wherein the tabs extend adjacent one another more than three-eighths of an inch beyond the boss and the downturned edge and are sized for marking and applying pressure-sensitive adhesive labels for labeling the article enclosed within the protective case.

13. The protective case of claim 8 wherein a substantially impervious seal is formed between the two elements for preventing the article enclosed within the protective case from being soiled.

14. The protective case of claim 8 wherein the two elements are constructed from transparent plastic material.

15. A case for protecting a relatively thin article such as a paper collectible which may be a sports card or a photograph or a like article comprising:

a base constructed from an elastic transparent plastic material, the base including a peripheral boss which encircles the article when the article is placed on the base, the height of the boss being less than one-quarter inch whereby typically the boss is of a height which exceeds the thickness of said relatively thin article and yet permits the placing of a relatively small number of such articles on the base within said peripheral boss, the number being dependent upon the article thickness; and a cover constructed from an elastic transparent plastic material, the cover including a downturned edge extending less than one-quarter inch, which is adjacent the peripheral boss when the cover is applied to the base, the peripheral boss and the downturned edge cooperating to comprise locking means for maintaining the base and the cover adjacent one another when the cover is applied to the base, the base and the cover being generally co-extensive in length and width and generally rectangular in shape each having a tab extending outwardly from a same side thereof for a distance greater than three-eights of an inch, said tabs being adjacent one-another and generally co-extensive with said end of the base and cover, whereby the base and cover fit together for enclosing the article within a region formed between the base and cover and the tabs are sized for marking and for applying pressure-sensitive adhesive labels for labeling the article enclosed within the protective case.

16. The protective case of claim 15 in which the tabs extend one-half inch beyondd said end and the interior of the base defined by the peripheral boss is slightly in excess of two and one-half inches by three and one-half inches.

17. The protective case of claim 15 in which the tabs extend one-half inch beyond said end the interior of the base defined by the peripheral boss is slightly in excess of two and five-eights inches by three and three-quarters inches.

* * * * *